US006946964B1

(12) United States Patent
Pitts-Crick

(10) Patent No.: US 6,946,964 B1
(45) Date of Patent: Sep. 20, 2005

(54) SAFETY DEVICE

(76) Inventor: Jonathan Pitts-Crick, Burnett House, Burnett, Bristol, BS31 2TF (GB)

( * ) Notice: Subject to any disclaimer, the term of this patent is extended or adjusted under 35 U.S.C. 154(b) by 2 days.

(21) Appl. No.: 10/130,895

(22) PCT Filed: Nov. 27, 2000

(86) PCT No.: PCT/GB00/04492

§ 371 (c)(1),
(2), (4) Date: Jun. 17, 2002

(87) PCT Pub. No.: WO01/39149

PCT Pub. Date: May 31, 2001

(30) Foreign Application Priority Data

Nov. 25, 1999 (GB) ..... 9927726

(51) Int. Cl.[7] ..... G08B 23/00
(52) U.S. Cl. ..... 340/573.1; 340/506; 340/665; 600/587
(58) Field of Search ..... 340/573.1, 692, 340/506, 524, 545.7, 614, 665, 666, 500; 600/587, 595; 200/502, 537

(56) References Cited

U.S. PATENT DOCUMENTS

| | | | | |
|---|---|---|---|---|
| 6,028,520 A * | 2/2000 | Maehre | ..... | 340/573.1 |
| 6,211,787 B1 * | 4/2001 | Yoshiike et al. | ..... | 340/573.1 |
| 6,222,144 B1 * | 4/2001 | Nishikawa | ..... | 200/537 |

FOREIGN PATENT DOCUMENTS

| | | | |
|---|---|---|---|
| DE | 196 25 558 | | 1/1998 |
| WO | WO 99 28880 | | 6/1999 |
| WO | WO99/28880 | * | 6/1999 |

* cited by examiner

*Primary Examiner*—Phung T. Nguyen
(74) *Attorney, Agent, or Firm*—Gifford, Krass, Groh, Sprinkle, Anderson & Citkowski, P.C.

(57) ABSTRACT

Sensor means for monitoring the awareness status of an individual within a monitored environment (50) comprising means (55) for determining the attainment of at least one predetermined condition identifying the requirement for the awareness of an individual to be monitored, and operative to trigger an alarm (70), means (15) operable by the monitored individual for inhibiting the operation of the alarm, and delay means for delaying the triggering of the alarm (70) for a predetermined period after the attainment of the said predetermined condition.

14 Claims, 5 Drawing Sheets

SAFETY DEVICE

BACKGROUND OF THE INVENTION

1. Field of the Invention

The present invention relates generally to a safety device and particularly to a safety device for use in situations where it is necessary to maintain consciousness or at least awareness. Such situations include, without limitation, those where an individual at risk may be otherwise unsupervised.

2. Description of the Related Art

In a hospital or like environment it is important that the consciousness or awareness status of an individual is known to the staff. This is of the utmost importance in connection with patients whose state of health is uncertain, such as patients undergoing tests, those in hospital for observation or those convalescing or recovering from an operation. However, there are situations where a patient is not usually supervised, for example, toilet cubicles or washing facilities. If a patient falls ill and becomes unconscious or partly conscious whilst unsupervised in these situations it may be some time before they are found and located so that their condition can be attended to.

Toilet cubicles are particularly relevant in the case of people at risk of cardiac arrest, major pulmonary embolus or hypoglycaemia. It is known that many people have a circulatory arrest whilst in a toilet. This is not coincidental but rather, at least in part, because the vagal reaction makes them think that they need the toilet when it may in fact be an early response to the events leading to the collapse.

There are, of course, other circumstances where consciousness or awareness indications are required. For example it has long been the practice to provide the driver's cab of a railway locomotive with a device known as a "dead man's handle" which is to be maintained in an operative state by the train driver in order to ensure that he has not fallen asleep as a result of the essentially tedious nature of this task.

Some toilets and bathrooms are provided with emergency cords which must be pulled to trigger a signal to attract attention. However, it may not always be possible for the patient to pull such a cord, for example because they have fallen on the floor and/or are unconscious, or because they have become disorientated or confused as a result of a medical condition.

There exists the need for a device which requires a patient to do something positive to demonstrate that they do not need assistance.

Accordingly, the present invention provides sensor means for monitoring the awareness status of an individual within a monitored environment, comprising means for determining the attainment of at least one predetermined condition identifying the requirement for the awareness of an individual to be monitored, and operative to trigger an alarm, means operable by the monitored individual for inhibiting the operation of the alarm, and delay means for delaying the triggering of the alarm for a predetermined period after the attainment of the said predetermined condition.

The monitored environment may comprise an enclosed space. In a preferred embodiment the safety device is designed for use in a lavatory cubicle; however, other situations where individuals are not normally supervised, such as bathrooms or shower cubicles, are not beyond the scope of the invention.

The condition identifying the requirement for the awareness of an individual to be monitored may be no more than the presence of the individual in the monitored environment.

The means for detecting the presence of an individual may act either indirectly, for example by sensing operation of a door lock, or by remote sensing means sensitive to the presence of an individual within a range thereof, such as an infra red or other light beam or an ultrasonic detection means. In any case it is preferable that the individual cannot be present in the monitored environment without being detected. In the case of a door lock for a toilet it is therefore preferable that the associated door is biased to be open, by any suitable means, such as a spring. The lock is then required to hold the door closed so that an individual will be encouraged by this so not use the toilet without locking the door, and in doing so identify the requirement for him or her to be monitored.

In an alternative embodiment the device itself may be attached to or worn by a monitored individual and set to detect when the individual enters an otherwise unsupervised environment, for example a stairwell where visual monitoring by staff is not available. When in this environment, the user must maintain a button pressed or provide other awareness indication to prevent triggering of an alarm.

The positioning of the means for inhibiting the alarm within the monitored environment and its operation is preferably dictated at least in part by ergonomic considerations, so as to be accessible, comfortable and not inconvenient for the monitored individual to use. The means for inhibiting the alarm may be fixed in its position or movable to a limited extent to allow positioning for convenient use by a user regardless of his or her position in the monitored environment. Likewise all, or part of the means for inhibiting the alarm may be adjustable for the comfort and convenience of the monitored individual.

The means for inhibiting the alarm may be formed so as to be operable whilst a monitored individual is seated or standing and may be operable for example by a limb, hand, foot or digit, the general principle being that the action must be one requiring sentient control.

In a preferred embodiment the means for inhibiting the alarm is a push button pressed by a foot. However other suitable arrangements such as a pedal or hand-operated lever or one positioned to be operated by a knee, or a switch to be operated by a digit are not beyond the scope of the invention.

In a preferred embodiment the means for inhibiting the alarm is a push button which is located on the floor and is upstanding therefrom. It may be preferable, however, for the means for determining the attainment of a predetermined condition and/or the means for inhibiting the alarm to comprise a member which does not protrude substantially above the level of an associated surface so as not to present a risk of tripping. For example the member may comprise a laminar element such as a pressure pad to be placed on the floor whereby to be substantially level therewith, a membrane switch or a sunken button. A laminar element may be sensitive to pressure over part of its surface; markings or other visible indicia such as coloured areas may be provided to identify the required position of the user's feet or other actuating member.

For the visually impaired tactile indicators may be provided, such as surface roughening or small projections.

This principle could also be applied to the means for determining the requirement for monitoring the individual. For example a pressure pad or membrane switch could be positioned at the entrance of the monitored environment so as to be triggered as the individual enters.

The means for inhibiting the alarm may be resiliently biased to the alarm-activating position so that the bias has to be overcome by muscular effort to prevent the alarm from sounding.

In order to avoid the possibility that the operating limb, hand or foot may remain on the means for inhibiting the alarm following unconsciousness or illness, it is desirable for the alarm-inhibiting means to require deliberate muscular effort to maintain it in its operating position so that muscular relaxation upon loss of consciousness will result in the alarm being raised. The effort required to operate the means for inhibiting the alarm is therefore preferably more than that which could be satisfied merely by placing the weight of the limb, hand or foot on it.

It is preferable that the bias acts in such a way that it is unlikely that an individual could or would wish to act against it, either deliberately or inadvertently whilst in need of assistance. The required effort may be variable.

Although operation of the means for inhibiting operation of the alarm must be deliberate, the operation does not have to be continuous. For example, in the case of a lever which is pushed down, the lever may gradually return to its starting position, whereby the individual must periodically depress the lever to prevent activation of the alarm.

The means for inhibiting the alarm may further include a guard member or element which may be positioned to inhibit accidental operation.

In a preferred embodiment the guard comprises a U-shape raised collar and a push button is located in the recess defined therein. However, other means such as a flap or cover which must first be removed could also be envisaged.

The alarm may consist of audible, visual or other appropriate signals to alert the attention of supervising staff. The alarm may be localised to the area of the means for inhibiting the alarm and/or may be connected to a central monitoring system. Connection of the sensor means to the alarm and/or a central monitoring system may be direct or by telemetry.

The system preferably has means to avoid inappropriate activation of the alarm. For example, in the case of a toilet cubicle, in the normal course of events when an individual has finished using the toilet and wishes to leave the cubicle or wants to adjust the position of his or her foot he or she may have to release the means for inhibiting the alarm; it is undesirable for the alarm to sound immediately. This may be overcome by having a predetermined delay between such release and sounding of the alarm; any such time delay should not, however, be so long as to endanger a user with a genuine emergency.

Once the requirement for monitoring the individual is satisfied there may also be provided warning means which operate during the predetermined period after the attainment of this predetermined condition. The warning means will therefore be effective to serve as a reminder to operate the means for inhibiting the alarm, both initially as the individual enters the monitored environment and at any time during their occupation for example if they remove their foot to adjust its position, until the means for inhibiting the alarm are activated or the individual leaves the enclosed space. The warning means may comprise means for generating an audible; the signal may increase in frequency with time.

The system is preferably co-ordinated with the presence detector so that the alarm function is inactivated once the individual has left the cubicle. There may also be provided further means for deliberately inactivating the alarm function, for example a key held by a responsible person which may be used if the alarm has activated and staff are in attendance, the alarm no longer being required.

In the case of patients whose mental or physical state makes it unlikely or impossible for them to operate an alarm-inhibiting device requiring sentient muscular control it may be necessary or desirable to have an individual such as a healthcare auxiliary in close proximity to the monitored environment. In such cases there may be provided second means for inhibiting the operation of the alarm located externally of the monitored environment and operable by a supervisor able to maintain supervision of the monitored environment. In this case the second alarm-inhibiting means effectively ensures that the monitoring takes place.

To prevent the triggering of the alarm, operation of the second means for inhibiting the alarm may be required in addition to or instead of the means operable by the monitored individual. In the first case, operation of the second means could be used to ensure that the healthcare auxiliary remains in place in close proximity to the monitored environment. In the second case, operation of the second means could be used where the monitored individual, because of disability or mental state, is unable to operate the means for inhibiting the alarm, the healthcare auxiliary inhibits the alarm but is in close proximity to the monitored environment and may periodically assess their awareness, for example by speaking to the monitored individual to get a verbal response.

The second means for inhibiting the alarm may function in the same way as the means for inhibiting the alarm operated by the monitored individual, in that the means are resiliently biased to an alarm-activating position (such as a normally-closed switch) and require a continuous conscious action, such as pressing a button, to avoid triggering the alarm.

If the alarm sounds for any reason the lock of the cubicle door may automatically be opened to allow access to the individual. In hospitals this would not usually be needed because cubicles are normally equipped with means by which they can be opened from outside in an emergency.

The system may be retrofitted to existing enclosed spaces or installed upon initial construction.

BRIEF DESCRIPTION OF THE DRAWINGS

Various embodiments of the invention will now be more particularly described by way of example, with reference to the accompanying drawings, in which.

DETAILED DESCRIPTION OF THE INVENTION

Figure 1:
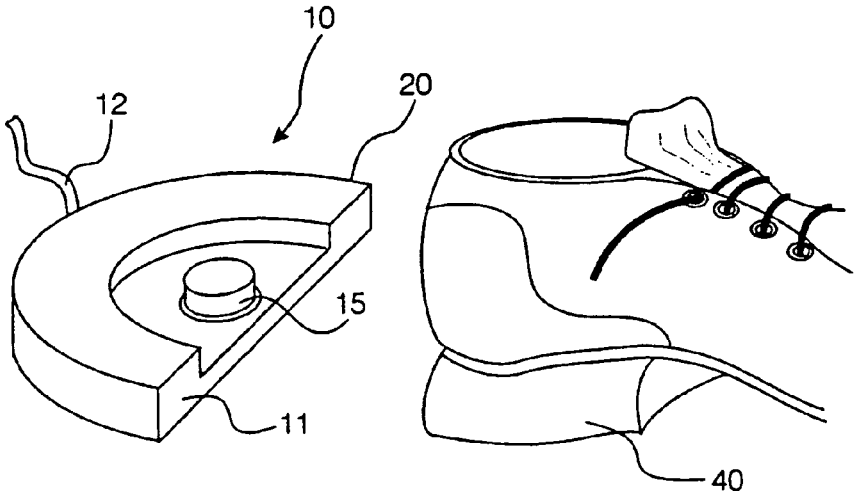
FIG. 1 is a schematic perspective view of switch means for inhibiting an alarm according to a first embodiment of the present invention.

Referring first to FIG. 1 there is shown switching means generally indicated 10 for use in a system for inhibiting an alarm. An upwardly projecting foot-operated push-button 15 is positioned in the recess defined by a generally U-shape guard 20. The guard 20 is a raised collar which partly surrounds the push-button 15 and serves to prevent accidental depression thereof. The collar stands up from a base 11 which houses the switch components and is connected to the circuit by a cable 12 allowing the switch to be positioned comfortably for the user.

The push-button 15 is resiliently biased to the raised alarm activating position as shown in FIG. 1, and requires a user to apply pressures through his or her foot, such as by a heel 40 to depress it. The switch may alternatively be depressed by a toe.

Figure 2:
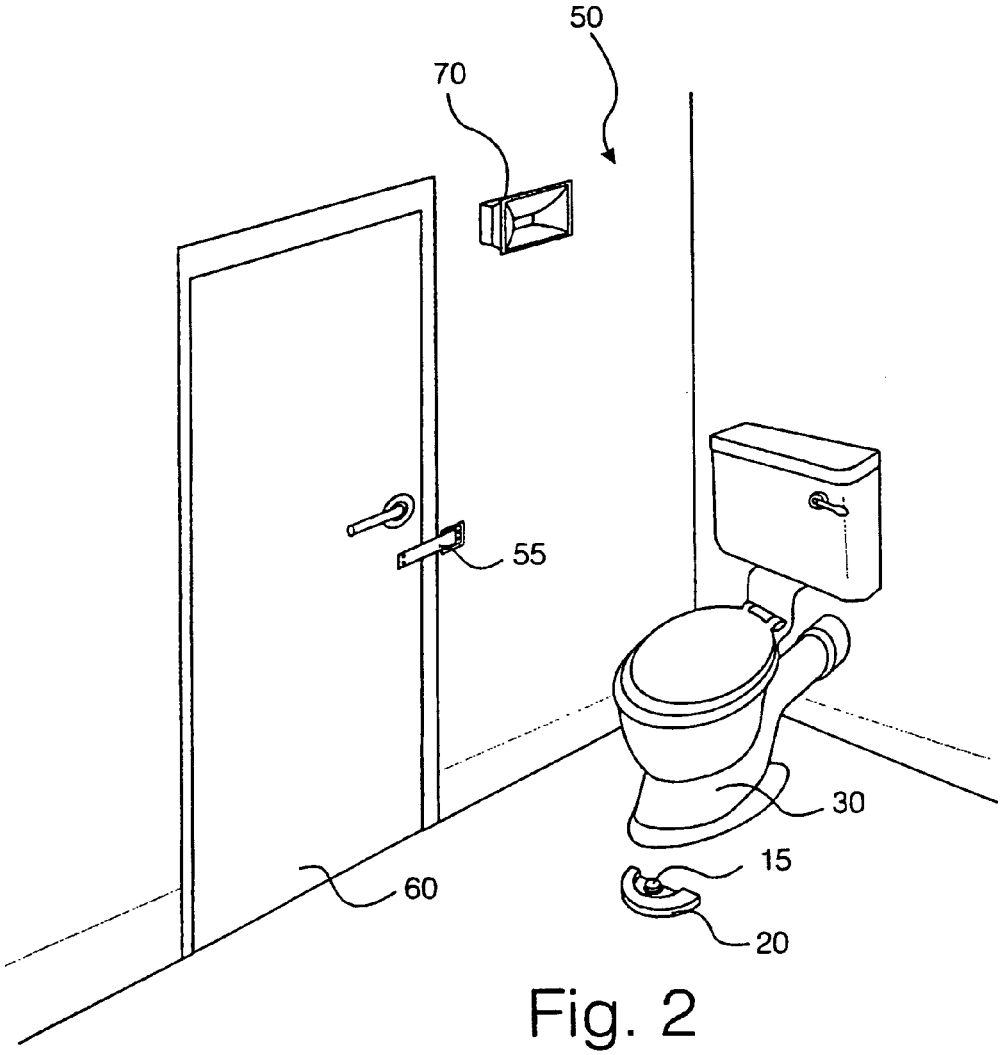
FIG. 2 is a schematic view of the system of the invention in situ in a toilet cubicle.

Referring now to FIG. 2 the main components of a system for monitoring a toilet cubicle generally indicated 50 are schematically illustrated. These comprise a door 60 with a lock 55 and a toilet pan 30. When an individual enters the cubicle 50 and operates the lock 55 of the cubicle door 60, the requirement for the awareness status of the individual to be monitored is triggered.

The push-button switch 15 is located adjacent the toilet 30 with the guard 20 positioned so as to prevent accidental or inadvertent depression of the pedal 15 by an individual present in the cubicle 50 in the vicinity of the toilet 30.

The switch operated by the pedal is closed when the pedal 15 is in the raised position so that, if left in this position, it will cause the alarm 70 to be activated after a delay period as will be described, in order to allow the individual sufficient time to adjust his or her clothes to make preparation to use the toilet. Once the individual is otherwise ready to use the toilet 30 the push-button 15 is depressed and maintained in the depressed state by deliberate pressure from the foot of the individual to prevent activation of the alarm 70.

Figure 3:
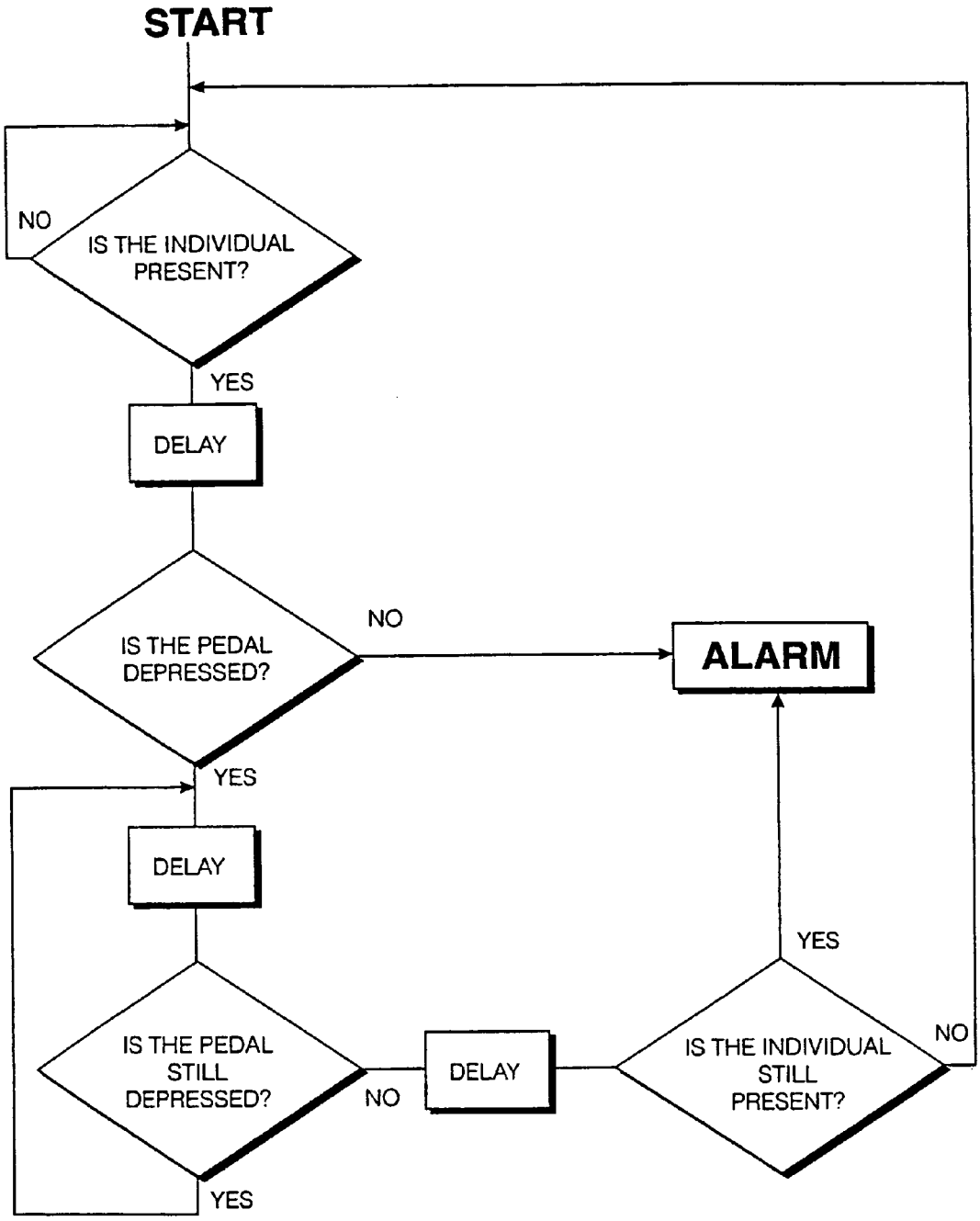
FIG. 3 is a flow chart illustrating the logical steps in the operation of the sensor means according to the first embodiment of the present invention.

Referring now to FIG. 3 there is shown a flow-chart illustrating the logical steps in the operation of the system of the invention. It will be appreciated that this is a schematic representation of the underlying logical steps and not a representation of the implementation of FIG. 1 or 2.

In the normal or monitoring state of the system it checks continuously whether an individual is present in the monitored environment. Whilst the answer to this question is "no" the system operates continuously in order to maintain a monitoring check on the environment. With the operation of the door lock 55 the necessary requirement for indication that an individual is present is met; after a predetermined delay the system checks whether the push-button 15 has been depressed by the individual. If the answer to this question is "no" the alarm is triggered.

If the push-button has been depressed by the user within the delay period the answer is "yes" and after a further short delay (of a few seconds) the system checks again that the push-button is still pressed.

So long as the answer to this question is "yes" a continuous loop operates repeating the check every few seconds.

When the pedal 15 is released, either because the individual is in need of assistance or is simply in the process of leaving the cubicle 50, the response to the monitoring check will indicate that the push-button is not still depressed. Then, after a predetermined delay the system checks if the individual is still present (indicated by the same means 55 as initially detected this status as discussed above). If the answer to this question is "no", the individual has left the cubicle 50 and the system returns to the initial state to maintain a monitoring check for the arrival of a new occupant. If the answer to this question is "yes" this indicates that the individual may be in need of assistance and the alarm 70 is immediately activated.

Figure 4:
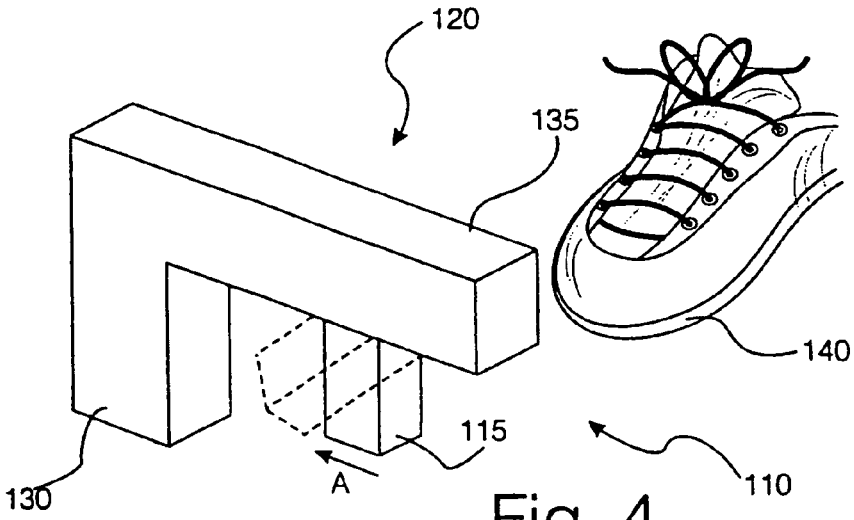
FIG. 4 is a schematic perspective view of means for inhibiting an alarm according to a second embodiment of the present invention.

Referring now to FIG. 4 there is shown alternative switch means suitable for use in inhibiting an alarm, generally indicated 110. This switch is suitable for permanent fixing to the floor of a monitored environment. A generally L-shape guard 120 comprises lower column or support 130 from which a transverse arm 135 projects laterally. The support 130 extends substantially vertically from the ground. At the upper end of the support 130 the transverse arm 135 extends generally orthogonally to form the L-shape guard 120. Within the included angle defined by the guard 120 a trigger lever 115 depends from the transverse arm 135. In use the foot 140 of an individual is introduced under the transverse arm 135 to reach the trigger lever 115 which is then pushed laterally in the direction shown by the arrow A towards the support 130 to the position shown in phantom outline to inhibit the alarm. The force required to maintain the button depressed will require that if the user loses consciousness and experiences muscle relaxation the trigger lever 115 will more back to its original position and trigger the alarm as discussed above.

Figure 5:
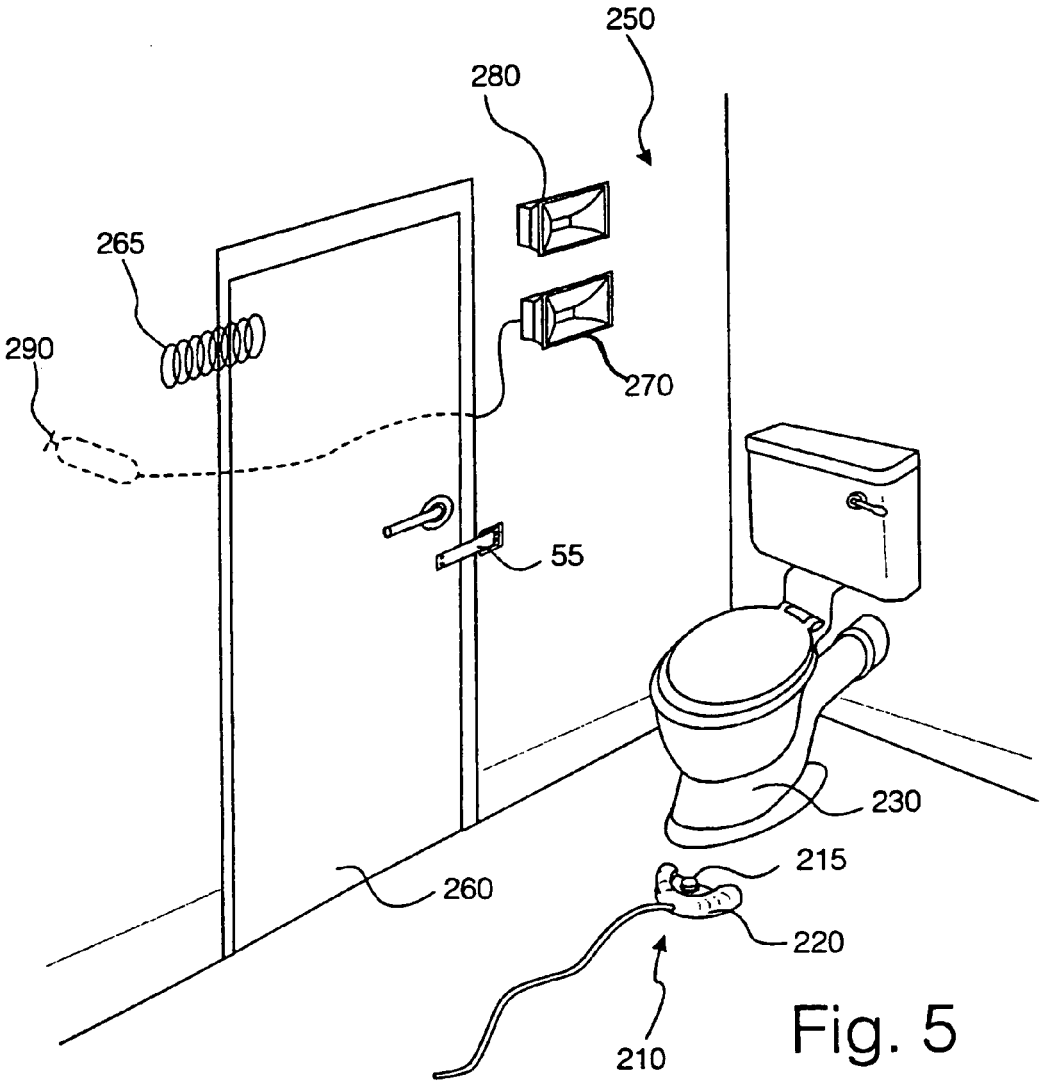
FIG. 5 is a schematic perspective view of a system formed as a third, more comprehensive, embodiment of the present invention in situ in a toilet cubicle.

Referring now to FIG. 5 the main components of a second embodiment monitoring system for a toilet cubicle generally indicated 250 are schematically illustrated. These comprise a door 260 with a lock 255 and a toilet pan 230. The door 260 is resiliently biased to an open position by the operation of a spring 265 illustrated only schematically, and will therefore not remain closed unless the door is held shut, for example by operating the lock 255. When an individual enters the cubicle 250 and operates the lock 255 of the cubicle door 260, the requirement for the awareness status of the individual to be monitored is triggered.

In this embodiment the switch means for inhibiting the alarm are formed as a portable unit generally indicated 210 similar to that in FIG. 1. A generally semi-circular guard 220 has a raised collar defining a U-shape recess. In this embodiment the guard 220 is made of rubber so as to be durable and hard-wearing. A push button 215 is positioned in the U-shape recess of the guard 220 for opening a switch within the body of the device.

The switch means 215 are kept closely adjacent the toilet pan 230 and are in contact with the necessary components of the sensor device via a wire 240. In other embodiments (not shown) a remote (i.e. wireless) link may be used.

The push button 215 is shown in the raised, alarm-activating position and if left in this position will cause an alarm 270 to be activated after a delay period as will be described, in order to allow the individual sufficient time to adjust his or her clothes to make preparation to use or leave the toilet 230 or adjust his or her foot during use. Once the individual is otherwise ready to use the toilet 230 the push-button 215 is depressed and maintained in the depressed state by deliberate pressure from the foot of the individual (not shown) to prevent activation of the alarm 270 as before. The system also includes second means for inhibiting the alarm indicated 290 located outside the toilet cubicle 250. The second means 290 is preferably a hand-held switch having a push-button 295 which is resiliently biased to the alarm activating position.

The delay period defines a period of time during which the requirement for monitoring the individual is satisfied and the push button 215 is not depressed but the alarm 270 is not activated. During this time an alert 280 sounds to serve as a reminder to the individual that the push-button 215 needs to be depressed or else the alarm 270 will be activated.

The alert 280 produces an audible signal which increases in frequency with time.

The second means 290 is located outside the toilet cubicle 250 so as to be operable by an attendant. The push-button 295 must be depressed at all times the occupant remains within the cubicle if he or she is unable to press the button 215 this prevents the attendant from leaving the immediate area. The attendant must thus remain in close proximity to the monitored individual and may periodically determine the awareness of the monitored individual, for example by verbal contact.

Figure 6:
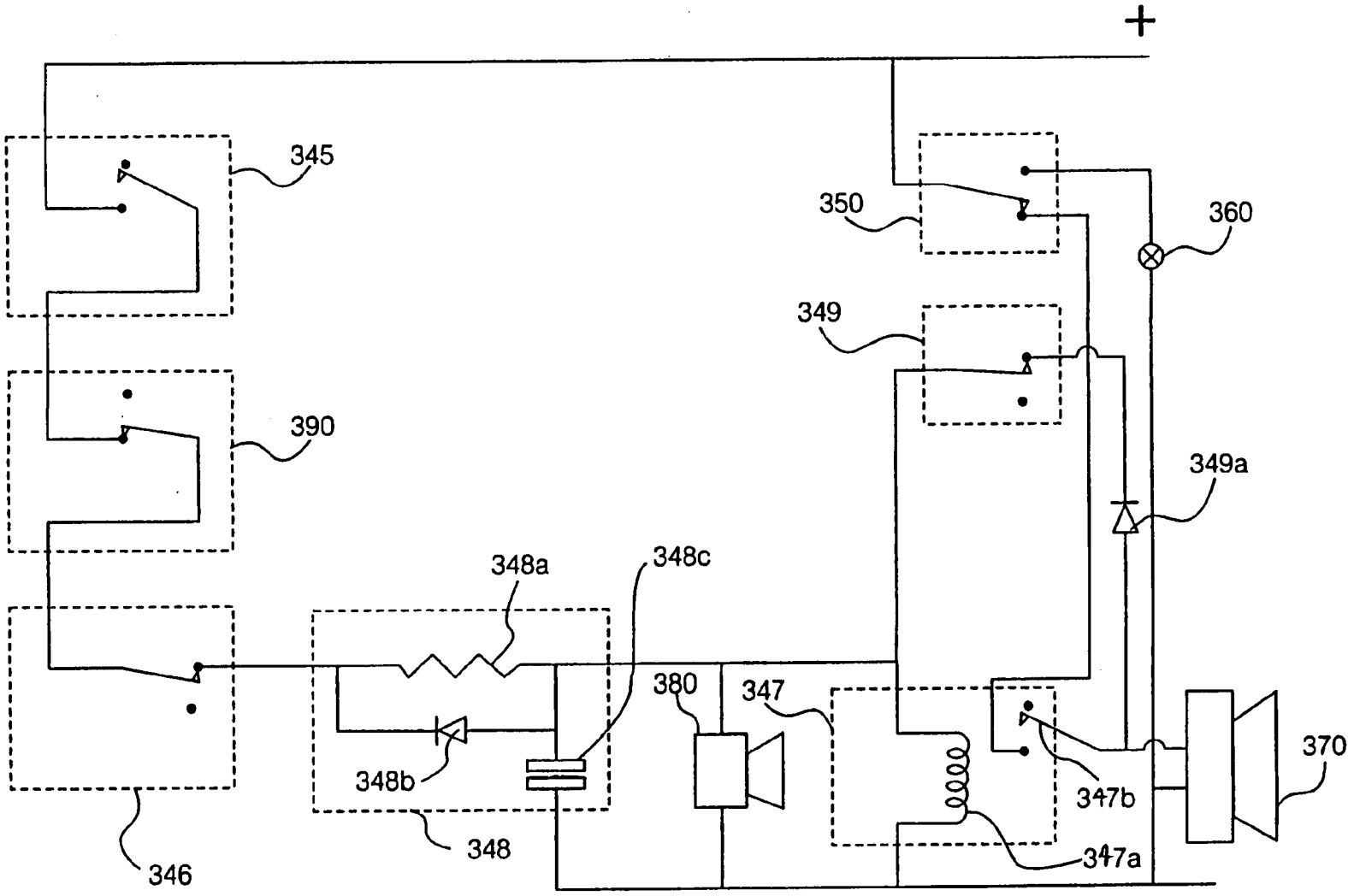
FIG. 6 is a circuit diagram illustrating the main electrical components used in the system forming the third embodiment of the present invention.

Referring now to FIG. 6 there is shown a circuit diagram illustrating the components required for the operation of the third embodiment of the invention.

The circuit comprises a door lock switch 345 operated by the door lock 255, an alarm-inhibiting switch 346 operable by the push button 215, an external alarm inhibiting switch 390 operated by the hand held unit 290, a delay circuit 348, an alarm 370, an alerting circuit 380, a relay 347, an alarm cancel switch 349, a master alarm cancel switch 350 and a warning light 360.

The door lock switch 345 is a normally open switch and is closed by the operation of the door lock 255 (of FIG. 5).

The external alarm inhibiting switch 390 is a normally closed switch and can be opened by operation of the push-button of the hand unit 290 (shown in FIG. 5) by an attendant.

The alarm inhibiting switch 346 is a normally closed switch and can be opened by operation of the push-button 215 (shown in FIG. 5) by the monitored individual.

The switches 345, 390, 346 are all connected in series, such that when the door is locked and neither of the push-buttons 290, 215 are opened a current will flow to the delay circuit 348.

The delay circuit comprises a resistor 348*a*, a diode 348*b* in parallel with it and a capacitor 348*c* which is connected between the resistor 348*a* and a ground line 381.

If all three switches 345, 346, 390 are closed current flows through the resistor 348*a* and charges the capacitor 348*c* to produce a steadily increasing voltage at the alerting circuit 380 and the relay 347. The alerting circuit thus produces an audible signal the frequency of which, being voltage dependent, gradually increases.

The relay 347 comprises a coil 347*a* and relay contacts 347*b*. When the voltage from the delay circuit 348 reaches a threshold level the current through the coil is sufficient to close the relay contacts 347*b* and the alarm 370 is activated.

The relay 347 is self-latching in that, when the switch 347*b* is closed current also flows via a diode 349*a*, through a normally closed alarm cancel switch 349 to the coil 347*a*. With this loop active, the switch 347*b* will remain closed even if any of the switches 345, 390, 346 are then opened to stop the current flowing through the delay circuit, because the alarm cancel switch directs current through the coil 347*a* irrespective of the status of these switches 345, 390, 346. If all of the switches 345, 390, 346 are closed, operating the alarm cancel switch 349 will not stop the alarm 370. However, if one or more of the switches 345, 390, 346 are opened again, indicating that there is not in fact an emergency, the alarm cancel switch 349 can then be operated to stop the alarm 370.

When an alarm condition exists and the alarm 370 is active, a key-operated master alarm cancel switch 350 is operable to stop the alarm 370 to allow remedial or resuscitation work to be carried out without the added stress of the alarm sounding throughout this procedure. However the switch 350 is a changeover switch so that when the alarm 370 is stopped in this way a warning light 360 is illuminated to indicate this fact, and to alert staff to the need to reset the equipment when the current emergency is over.

Figure 7:
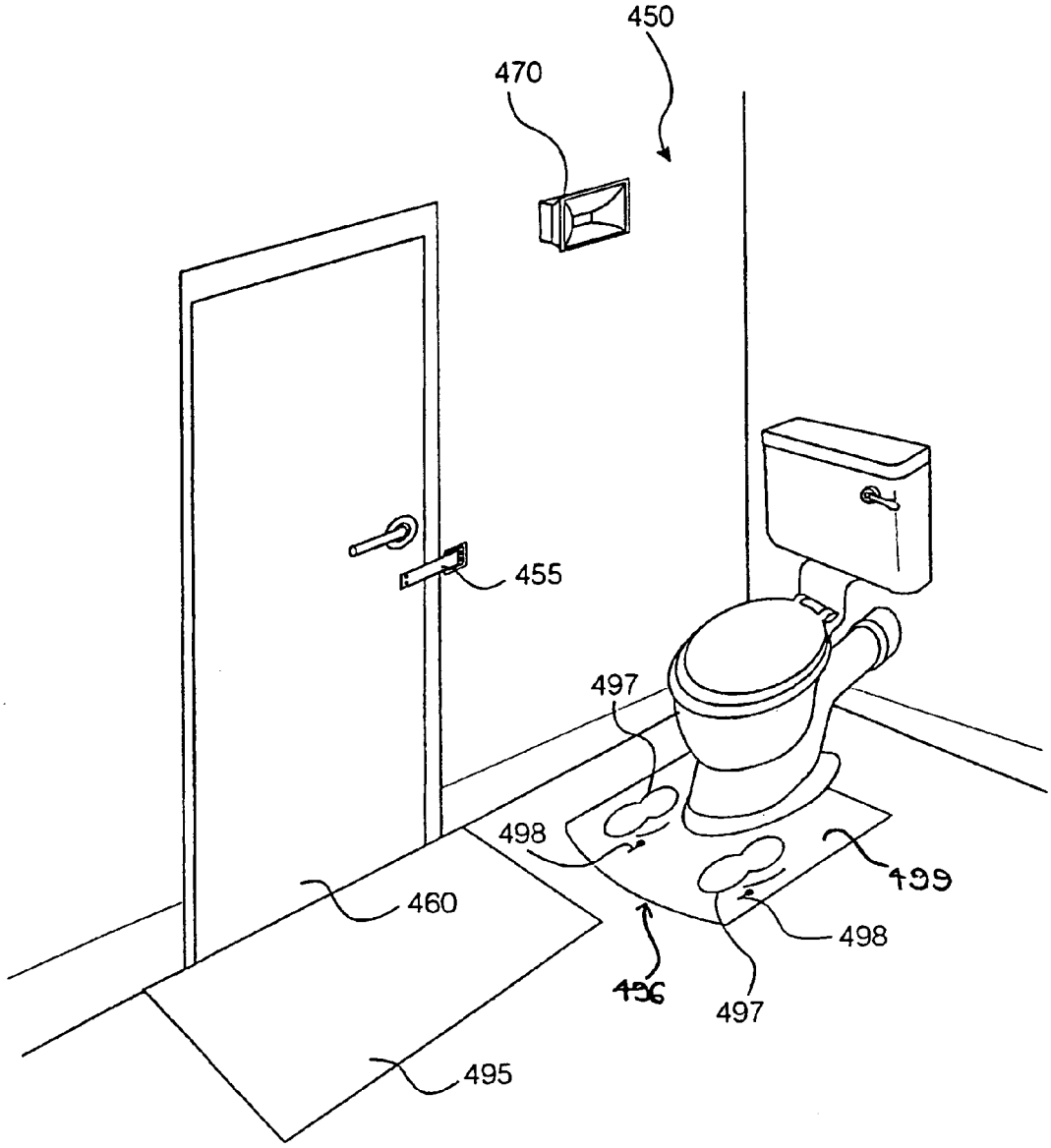
FIG. 7 is a schematic perspective view of a system formed as a further embodiment of the present invention.

FIG. 7 shows further embodiment having alternative means for identifying the requirement for monitoring an individual, and alternative means for inhibiting the operation of the alarm. A toilet cubicle is generally indicated 450 and comprises a door 460 with a lock 455 and a toilet 430. A pressure sensitive pad 495 is located on the floor immediately adjacent the door 460. The pad 495 is a laminar element which does not, therefore, present a risk of tripping. The dimensions and positioning of the pad is such that when an individual enters the cubicle 450 the requirement for the awareness status of the individual to be monitored is triggered. A second pressure sensitive pad 496 is located on the floor adjacent the toilet 430 again the pad is a laminar element and does not present a risk of tripping.

Markings 497 define an area on which the user's feet are to be placed; the pad can be moved to allow it to be positioned comfortably for the user. Within the pad 496 defined by the markings 497 are switches 498 (shown schematically). The switches 498 are operated by pressure and are identical in function to the pedal 15 already described in relation to FIG. 1.

The mere presence of the markings 497 and the requirement to place the feet in predetermined positions represents a first level of monitoring of awareness as this act requires a conscious effort. A second level is achieved by the requirement for pressure to be exerted and maintained upon the switches 498.

In addition, in this embodiment the area of the pad 496 not occupied by the markings 497 is an 'exclusion zone', as defined below.

An important feature of this embodiment is that, in addition to pressure being required on the markings 497 to inhibit the alarm, it is also a requirement that there is no pressure on the remainder of the pad 496—the exclusion zone 499. This is to remove the possibility that an individual falls and yet remains in contact with one or both of the markings 497. Therefore, contact on the markings 497 inhibits the alarm 470, whilst contact on markings and the exclusion zone does not. The exclusion zone 499 overrides the inhibitory effect of the markings 497.

What is claimed is:

1. Sensor means for monitoring the awareness status of an individual within a monitored environment comprising means for determining the attainment of at least one predetermined condition identifying the requirement for the awareness of an individual to be monitored, and operative to trigger an alarm, means operable by the monitored individual for inhibiting the operation of the alarm, and delay means for delaying the triggering of the alarm for a predetermined period after the attainment of the said predetermined condition, wherein the means for inhibiting the alarm are resiliently biased to an alarm activating position such that the means for inhibiting the alarm requires deliberate muscular effort to overcome the resilient biasing, further comprising second means for inhibiting the operation of the alarm located externally of the monitored environment and operable by a supervisor able to maintain supervision of the monitored environment.

2. Sensor means as claimed in claim 1, in which the monitored environment comprises an enclosed space.

3. Sensor means as claimed in claim 1, in which the monitored environment is a cubicle.

4. Sensor means as claimed in claim 1, in which the monitored environment is a lavatory cubicle.

5. Sensor means as claimed in claim 1, in which the means for determining the attainment of a predetermined condition detects the presence of a monitored individual within the monitored environment.

6. Sensor means as claimed in claim 5, in which said means for detecting the presence of a monitored individual act indirectly by sensing operation of a door lock.

7. Sensor means as claimed in claim 5 in which the means for detecting the presence of the monitored individual act by remote sensing means sensitive to the presence of an individual within a range thereof.

8. Sensor means as claimed in claim 1 in which the means for inhibiting the alarm are operable by a limb of the monitored individual.

9. Sensor means as claimed in claim 1, in which the means for inhibiting the alarm are operable by a foot of the monitored individual.

10. Sensor means as claimed in claim 1, in which the means of inhibiting the alarm comprise a pedal.

11. Sensor means as claimed in claim 1, in which the means for determining the attainment of a predetermined condition and/or the means for inhibiting the alarm comprise a member which does not protrude substantially above the level of an associated surface so as not to present a risk of tripping.

12. Sensor means as claimed in claim 1, further comprising warning means which operate during the said predetermined period after the attainment of the said predetermined condition.

13. Sensor means as claimed in claim 12, in which the warning means comprise means for generating an audible signal.

14. Sensor means as claimed in claim 1, in which the means for inhibiting the alarm further comprise a guard for preventing accidental operation.

* * * * *